US006148873A

United States Patent [19]

Mehre

[11] Patent Number: 6,148,873

[45] Date of Patent: Nov. 21, 2000

[54] APPARATUS FOR PRODUCING REINFORCING CAGES FOR RECTANGULAR PIPES MADE OF CONCRETE

[75] Inventor: Klaus Mehre, Kisslegg, Germany

[73] Assignee: MBK Maschinenbau GmbH, Kisslegg, Germany

[21] Appl. No.: 09/281,263

[22] Filed: Mar. 30, 1999

[30] Foreign Application Priority Data

Mar. 30, 1998 [DE] Germany ..... 198 14 091

[51] Int. Cl.[7] ..... B21F 27/10

[52] U.S. Cl. ..... 140/112; 140/71 R

[58] Field of Search ..... 140/71 R, 112; 219/56

[56] References Cited

U.S. PATENT DOCUMENTS

| | | | |
|---|---|---|---|
| 3,579,259 | 5/1971 | Kato | 140/112 |
| 5,446,254 | 8/1995 | Ritter et al. | 140/112 |

FOREIGN PATENT DOCUMENTS

| | | |
|---|---|---|
| 3634736C2 | 4/1988 | Germany . |
| 3809420C1 | 8/1989 | Germany . |
| 4201872C2 | 7/1994 | Germany . |
| 19535547A1 | 3/1997 | Germany . |

*Primary Examiner*—Lowell A. Larson
*Attorney, Agent, or Firm*—Venable; George H. Spencer; Robert Kinberg

[57] ABSTRACT

A suitable automatically operating apparatus is proposed for producing reinforcing cages for rectangular pipes made of concrete. Longitudinal-wire sections, which are parallel to the pipe axis, are held together in a framework. The latter essentially comprises a perforated frame, which cannot be moved in the longitudinal direction, and a receiving frame, which can be displaced relative to the perforated frame. Rectilinear transverse-wire sections, angles or bent brackets are welded onto the longitudinal-wire configuration, to be precise onto the respective side surfaces of the longitudinal-bar configuration in a freely selectable manner. Fitting apparatuses which can be displaced perpendicularly with respect to the longitudinal-wire sections are used for this purpose. In addition to the wire thickness, it is also possible to select the spacings between the transverse-wire sections provided in each case. In the example, the framework can be rotated about a vertical axis on a carousel, in each case two mutually opposite fitting apparatuses interacting with two welding apparatuses arranged transversely thereto. The necessary transverse-wire sections are finished off in each case during the welding operation. The completed reinforcing cages are removed, and inserted one inside the other, by crane.

16 Claims, 3 Drawing Sheets

APPARATUS FOR PRODUCING REINFORCING CAGES FOR RECTANGULAR PIPES MADE OF CONCRETE

BACKGROUND OF THE INVENTION

The invention relates to an apparatus for producing reinforcing cages for rectangular pipes made of concrete. These reinforcing cages are required for large concrete pipes which have a rectangular or square cross section and of which the clear profile is, for example, in the order of magnitude of 2×4 m. The individual pipe sections are fitted together to give a pipeline or a through-channel and engage one inside the other in a positively locking manner by way of sockets or socket-like protrusions and recesses. The rectangular pipes are laid in the ground or covered with earth. In addition to water-engineering applications, these pipes can be used to produce, for example, pedestrian underpasses or passages under motorway embankments.

In the case of rectangular concrete pipes, in contrast to round concrete pipes, which have to be functional in every position, different wall regions are subjected to different degrees of loading. On account of the predominant bending loading, the top and bottom require considerably stronger steel reinforcement than the side walls. This means that the known wound reinforcing cages, which are dimensioned all the way round in accordance with the highest loading expected, are vastly over-dimensioned on the side walls. It is thus already known, in order to reduce the amount of steel used, for reinforcing cages to be configured individually over each surface area.

FIG. 1 shows a simplified illustration of a known rectangular concrete pipe and FIG. 2 shows a longitudinal section II—II through two concrete pipes which have been joined together, each concrete pipe containing an outer reinforcing cage 3 and an inner reinforcing cage 4. FIG. 3 shows a known reinforcing cage which is in the upright position and has longitudinal-wire sections 5 and a selection of different transverse-wire sections, it being possible to differentiate between rectilinear transverse-wire sections 6, transverse-wire angles 7 and transverse-wire brackets 8. The different static requirements which have to be met by the different reinforcing-cage surfaces can be satisfied in that a selection is made from the different transverse-wire sections, and in that these transverse-wire sections, in the case of relatively high stressing, are provided at smaller spacings apart in the longitudinal direction and/or larger wire cross sections are selected.

SUMMARY OF THE INVENTION

An object of the invention is to specify an automatically operating mechanical apparatus which is intended for producing such a reinforcing cage and, on account of an input program, selects the shape of the different transverse-wire sections and the wire used and provides these transverse-wire sections on the correct side of the reinforcing cage and at the correct longitudinal spacings.

This object is achieved according to the invention by providing that, in their configuration corresponding to the reinforcing cage which is to be produced, the longitudinal-wire sections are retained on a framework and guided such that they can be displaced longitudinally together. Furthermore, there is also provided at least one fitting apparatus which cuts the transverse-wire sections to length from a wire of a certain thickness, angles them if appropriate and then positions them on a certain side of the longitudinal-wire configuration at certain longitudinal spacings, and finally, there is provided at least one welding apparatus in order to weld these transverse-wire sections to the longitudinal-wire sections at the crossover location.

The production output of such an apparatus basically depends on the number of fitting and welding apparatuses used. In the case of a stationary framework, in each case four apparatuses would be necessary in order to work on each side. It is thus proposed that the framework be mounted such that it can be rotated about an axis of rotation which is parallel to the longitudinal-wire sections. In this case, it is sufficient to have one fitting and welding apparatus, since that side of the longitudinal-bar configuration which is to be processed in each case can be turned toward the relevant apparatus by 90° rotations. It is particularly advantageous to provide for a medium mechanical outlay, in other words two mutually opposite welding apparatus and two fitting apparatuses offset by 90° with respect to the latter.

It is particularly expedient, and not least advantageous for the handling of the completed reinforcing cages, if the framework is aligned vertically, and thus the vertical longitudinal-wire sections are raised during the production sequence and, in the process, fitted from top to bottom with transverse-wire sections. During production, the reinforcing cage, as it were, grows upward from the framework, and it is then easily possible for it to be raised up in this direction, conveyed away and set down again by a crane. If desired, it may then be immediately joined together with a previously produced reinforcing cage of smaller or larger diameter. The finished double cage need not be turned any longer even for insertion into the concrete-pipe mold.

The framework essentially comprises a top, perforated frame, which is arranged at a constant height, and a bottom, receiving frame, which can be raised. The two horizontally arranged frames determine the cross section of the reinforcing cage. The perforated frame has through-holes into which the longitudinal-wire sections are inserted, with the result that they can be displaced freely therein. The receiving frame may have corresponding receiving depressions in order to receive the bottom ends of the longitudinal-wire sections and, if necessary, to clamp them firmly therein by special auxiliary means. The perforated frame is preferably prepared with the holes for two reinforcing cages in each case, namely for a smaller, inner reinforcing cage and a larger, outer reinforcing cage, these being used together as a double reinforcing cage for a certain concrete pipe.

The receiving frame can be raised in steps, always in the horizontal position, in a program-controlled manner by means of a lifting apparatus arranged in the interior of said receiving frame. In this case, it pushes all the longitudinal-wire sections upward, these advancement steps determining the spacings between the transverse-wire sections. The lifting apparatus preferably comprises a plurality of spindles, with the result that, with the use of suitable motors for the spindle drive, the advancement can be controlled very accurately. Irrespective of the height advancement, the entire framework, including the lifting apparatus, is provided rotatably on a carousel.

Toward the end of the production operation, the spacing between the perforated frame and the receiving frame becomes smaller and smaller, with the result that the vertical guidance of the emerging reinforcing cage could present problems. It is thus proposed that the reinforcing cage, in this half-completed state, be gripped by the abovementioned crane system, and that the crane draw the reinforcing cage upward in steps, in a program-controlled manner, in the last phase of the production sequence. In order to satisfy the advancement-accuracy requirements in the same way as the lifting apparatus of the receiving frame, the crane has to be equipped correspondingly.

The fitting apparatus, i.e. a complex apparatus with various tasks, is arranged on the plane of the perforated frame. It is provided first of all for drawing off wire from at least one wire roll, via an aligning means, cutting said wire to length as required and pushing the resulting rectilinear transverse-wire section transversely up to one side of the longitudinal-wire configuration. It is also provided that, in addition to rectilinear transverse-wire sections, the fitting apparatus also makes available straightforward transverse-wire angles or U-shaped transverse-wire brackets, which are angled at both ends, and likewise pushes these up to the longitudinal-wire configuration. The fitting apparatus contains at least one slide which is suitable for this process. Finally, there are two bending apparatuses in order to form either two transverse-wire angles or one transverse-wire bracket. The bending apparatuses each contain a radius template and a bending arm fitted with a bending roller, these being guided downward, following the bending operation, to the extent where the bent transverse-wire sections remain lying on the perforated frame or the slide and can be pushed up to the longitudinal-bar configuration in a horizontal movement without obstruction.

In order to be able to select at least two different wire diameters, it is expedient for each fitting apparatus to be assigned two wire rolls, these pushing the respective wire end into the fitting apparatus from opposite sides. In this case, only one aligning means and one roll is in operation. It is preferable for two fitting apparatuses to be arranged on opposite sides of the longitudinal-wire configuration. In this case, each fitting apparatus is assigned two wire rolls.

In terms of construction, the welding apparatuses may correspond to those used in the case of known reinforcing-cage winding machines. As far as the arrangement and movability of the welding apparatuses are concerned, two proposals are made as developments of the invention.

On the one hand, there may advantageously be provided a welding apparatus which can be moved rectilinearly in two mutually perpendicular horizontal directions in a certain movement region and can weld a transverse-wire section on a side surface of the longitudinal-bar configuration, it being the case that said welding apparatus moves back in order to give the framework and the longitudinal-bar configuration space for a 90° rotation, and then move forward in order to perform a welding operation on an adjoining side surface. In this case, the welding apparatus is advanced by its own longitudinal drive in relation to the transverse wire which is to be welded on, i.e. along the side surface.

An alternative embodiment could consist in the fact that a radially displaceable welding apparatus is provided, of which the advancement on the transverse-wire section is brought about by the movement of the welding apparatus relative to the rotating framework. It is sufficient here for the welding apparatus to be pressed against the transverse wire or the framework by a certain force, which may be applied by a pneumatic operating cylinder.

If, as proposed above, two fitting apparatuses are provided, it is also recommended for two welding apparatuses to be provided on sides of the framework which are situated opposite one another and are not occupied by a fitting apparatus.

An exemplary embodiment of the invention is explained in more detail hereinbelow with reference to the drawings, although the abovementioned FIGS. 1 and 2 and FIG. 3, to the extent that they illustrates a reinforcing cage, belong to the prior art.

DETAILED DESCRIPTION OF THE PREFERRED EMBODIMENTS

Figure 3:
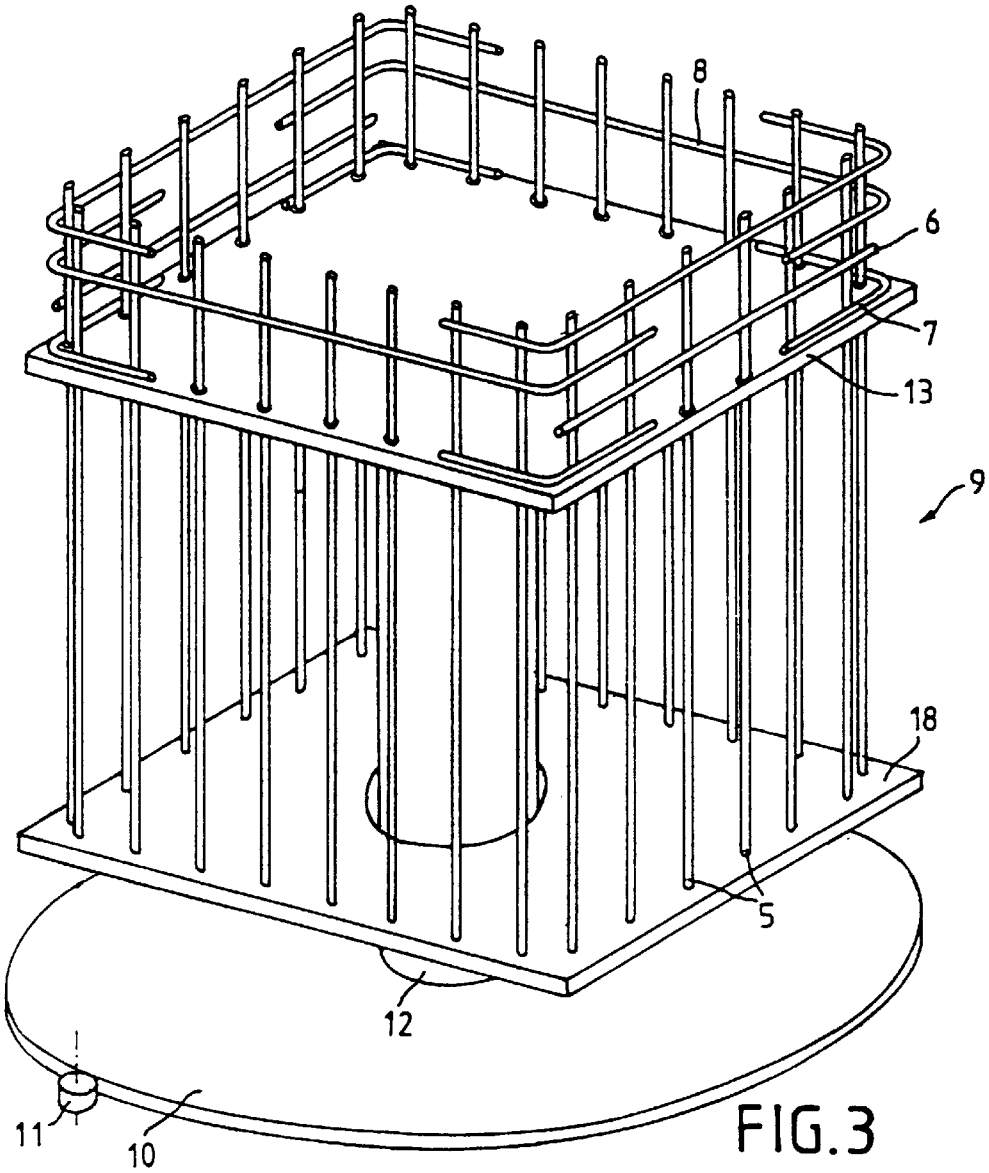
FIG. 3 shows, by way of example, a three-dimensional illustration of the typical parts of a reinforcing cage which is to be produced by the apparatus according to the invention and of certain elements of the framework of this apparatus.
Figure 1:
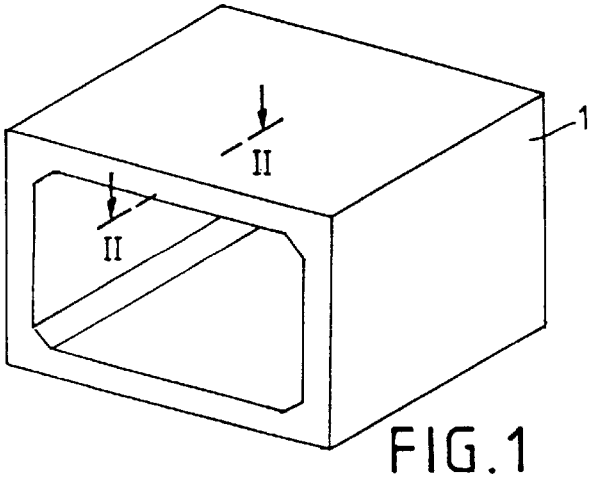
FIG. 1 shows the simplified three-dimensional illustration of a known rectangular concrete pipe.
Figure 4:
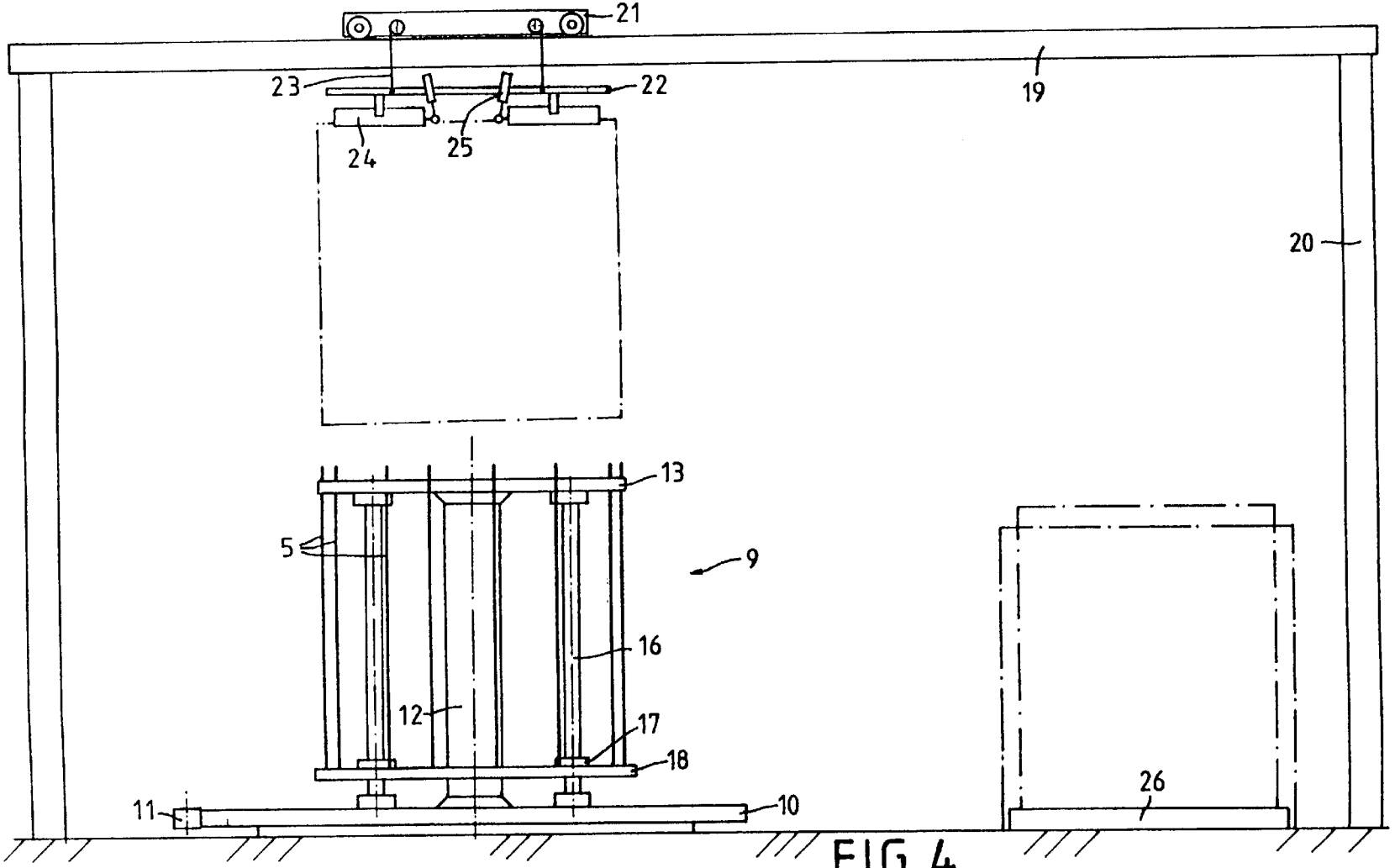
FIG. 4 shows an elevation of an apparatus for producing reinforcing cages.
Figure 5:
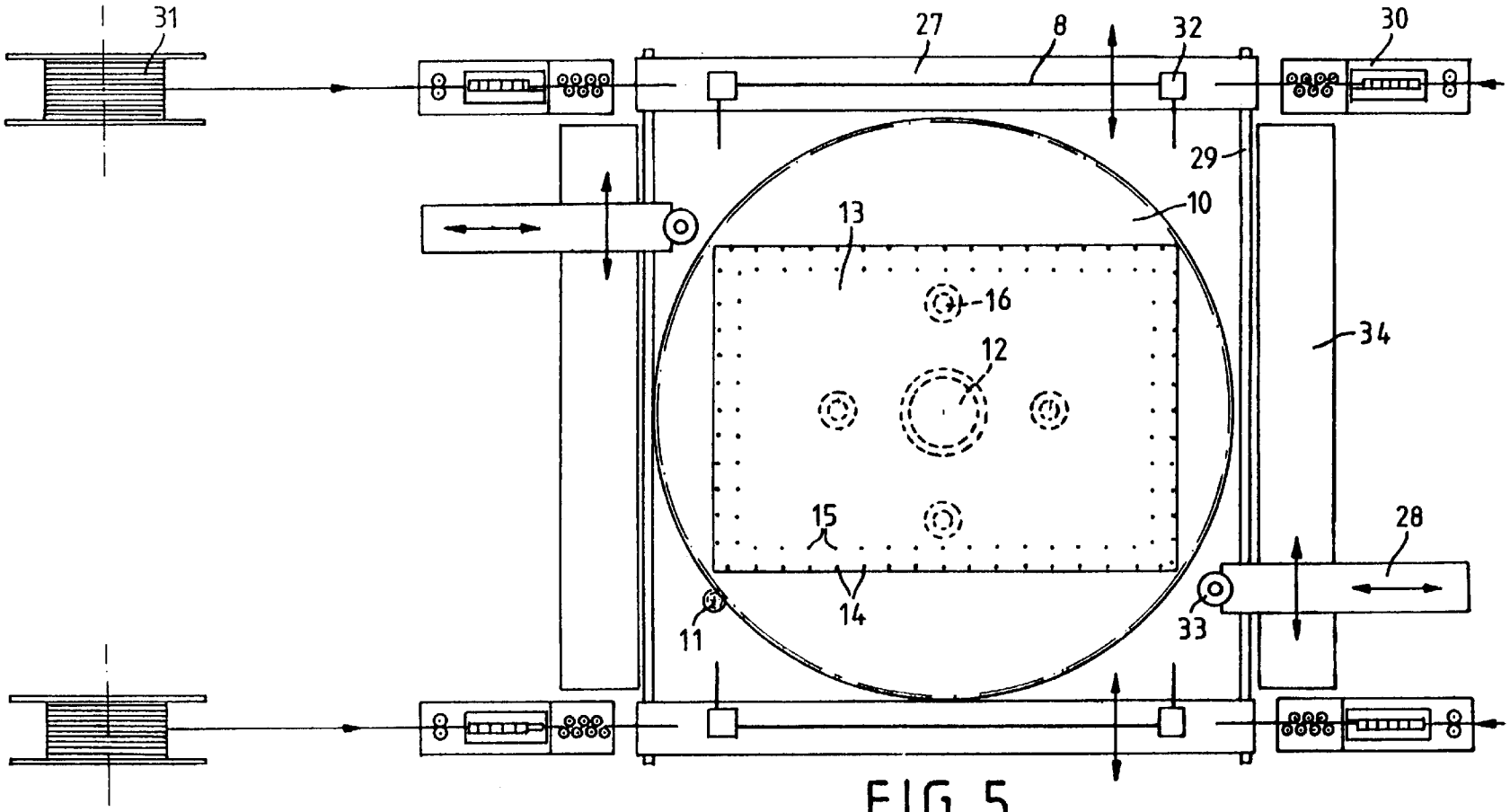
FIG. 5 shows the apparatus according to FIG. 4 in a plan view which has been rotated through 90°.

A framework 9 constitutes a basic element of the apparatus according to FIGS. 4 and 5. The framework comprises a carousel 10, of which the drive is indicated by a pinion 11. A perforated frame 13, or a perforated panel, is fastened on the carousel 10 by means of a central column 12. The plan view according to FIG. 5 shows that the rectangular perforated frame 13 has a border of holes 14 on the outer edge and a further border of holes 15 further inward. Mounted on the carousel 10 and the perforated frame are four vertical spindles 16, of which the spindle nuts 17 bear a receiving frame 18. The spindles are driven synchronously (in a manner which is not illustrated), with the result that the lifting steps made by the receiving frame 18 can be controlled accurately by means of a program. Vertically beneath the holes 14 and 15 of the perforated frame 13, the receiving frame 18 may have depressions in which longitudinal-wire sections 5 may be positioned, with the result that said longitudinal-wire sections project upward through the holes of the perforated frame 13. Instead of the receiving depressions, it is possible to provide stop strips, but it is also possible, if appropriate, to dispense with the same. FIG. 3, likewise schematically, shows the perforated frame 13 and the receiving frame 18 along with the carousel 10 and the column 12.

FIG. 4 additionally shows a portal crane. A running gear mechanism 21, on which a horizontal transporting frame 22 is suspended via four cables 23 moves on horizontal load-bearing members 19, which rest on supports 20. The transporting frame has a plurality of clamping rails 24. These are tong-like clamps which each comprise two horizontal rails mounted pivotably on one another and which can be actuated by means of in each case one lifting cylinder 25. These clamping rails serve for gripping in each case a plurality of longitudinal-wire sections at their top ends, to be precise irrespective of the thickness of the longitudinal wires and of the spacings between them. As an alternative, it is also possible, with the aid of movable catches or hooks provided on the transporting frame 22, for the completed reinforcing cage to be gripped at its transverse wires. In this case, however, the weld locations are subjected to cage-weight loading.

Figure 2:
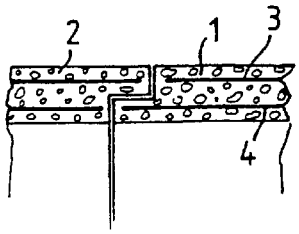
FIG. 2 shows a partial longitudinal section II—II through the concrete pipe according to FIG. 1.

On the right-hand side, alongside the framework, FIG. 4 indicates how, by means of the portal crane, the completed reinforcing cages 3 and 4 can be inserted one inside the other most easily and without being turned. The inner reinforcing cage 4 is positioned on a base 26. In this thus vertically displaced position, the two reinforcing cages are connected to one another by radial connecting elements (not shown) and can then be inserted together as a double cage, again without turning, into the concrete mold (not shown) for a rectangular pipe which is to be produced. FIG. 2 explains the purpose of the mutual displacement of the two individual cages. The respectively projecting reinforcing cage engages in the projecting edge region (socket) of the concrete pipe and increases the strength thereof.

FIG. 5 shows, alongside the framework 9, the fitting apparatuses 27 and welding apparatuses 28 (not illustrated in FIG. 4). These apparatuses are arranged in pairs on opposite sides of the framework 9, level with the perforated frame 13. For this purpose, the framework 9 is enclosed by corresponding uprights or a common load-bearing structure (which are not illustrated). For the sake of simplicity, the fitting apparatuses 27 are illustrated as rectangles. They can move radially, in relation to the carousel axis, in a controlled manner with respect to one another on horizontal rails 29 and can thus be guided up to the rectangle sides, which are spaced apart from the carousel axis to different extents. For rotation of the framework 9, the fitting apparatuses 27 are moved back into the position illustrated.

Each fitting apparatus may be fed optionally by two aligning means 30, which draw off wires of different thicknesses from wire-storage drums 31. The aligning means 30 push in the wire in the longitudinal direction of the relevant apparatus from opposite sides. In each case, it is ensured that the aligning means 30, which, as is known, comprises a group of driven rollers, is stopped once the required wire length has been pushed in, that the wire is then automatically cut off, and that where possible the drum-side wire end is drawn back again to some extent. A straightforward cutting-to-length operation is used to produce the rectilinear transverse-wire sections 6 (FIG. 3). A longer wire length is optionally received and, thereafter, two bending apparatuses 32, which are schematically illustrated as squares, come into operation. They bend the wire ends approximately at right angles and thus produce transverse-wire brackets 8. Such brackets are shown by way of example in FIG. 5. The same apparatus, however, can also be used to introduce a short piece of wire or two short pieces of wire at a spacing apart. The bending apparatuses 32 make transverse-wire angles 7 therefrom. In each case, following completion of the transverse-wire sections, the latter are guided up to the side surface of the longitudinal-bar configuration (rectangle side), pressed against the same and then welded firmly thereon. Before transverse-wire angles and transverse-wire brackets are finally placed in position, the parts of the bending apparatus 32 which obstruct the positioning movement have to be drawn away upward or downward.

The respective welding apparatus 28 comprises a rotatably mounted welding wheel 33. In a movement region 34, the apparatus can move back and forth in two mutually perpendicular arrow directions, i.e. toward the framework and away from the same and along the side wall of the longitudinal-wire configuration.

The production apparatus described operates as follows:

In the starting position, the receiving frame 18 is located in its lowermost position, i.e. it rests virtually on the bottom bearings of the spindles 16. Thereafter, first of all the previously cut-to-length longitudinal-wire sections 5 are pushed through the holes of the perforated frame 13 and positioned at the bottom on the receiving frame 18. The longitudinal-wire configuration is first to be fitted with two transverse-wire brackets 8. The latter are produced in the fitting apparatuses 27, as have been described, with the aid of the bending apparatuses 32. According to FIG. 5, said brackets are "long" transverse-wire brackets 8, which are provided for the long rectangle side. Should difficulties occur when the bent ends of the transverse-wire brackets 8 are being pushed on, it is conceivable to interrupt the bending movement before the full 90° has been reached and to complete the bending operation only once the ends have passed at least one longitudinal-wire section on the short rectangle side. The transverse-wire brackets 8 are held in abutment against the longitudinal-wire configuration with the aid of retaining apparatuses (not illustrated) installed in the perforated frame 13.

Once the fitting apparatuses 27 have returned into their starting position, the carousel rotates through 90°. Thereafter, the welding apparatuses 28 advance to such an extent that the welding wheels 33 come into contact with that section of the transverse-wire brackets 8 which butts against the long rectangle side, and weld said sections to the longitudinal-wire sections at the crossover locations. Once this has taken place, the welding apparatuses 28 likewise move back again, and this is followed by the next 90° rotation of the carousel 10. The welding apparatuses 28 then move forward again and weld the bent ends of the transverse-wire brackets 8 firmly on the short rectangle sides.

Once the welding apparatuses 28 have been moved back, the spindles 16 are driven, with the result that the receiving frame 18 is raised by a certain distance. In this case, the longitudinal-wire sections are displaced in the holes of the perforated frame 13. In the second stage reached, further transverse-wire sections which have been prepared in the meantime, i.e. rectilinear sections, angles or brackets, are placed in position and welded on in the same way following a 90° rotation of the carousel 10. The reinforcing cage thus grows upward out of the framework 9 until the receiving frame 18 has reached its top position, although in this case a considerable spacing still remains between the receiving frame 18 and the perforated frame 13. In this situation, the clamping rails 24 of the crane grip the reinforcing cage at the top ends of the longitudinal-wire sections, and the rest of the vertical advancement for completing the reinforcing cage is performed in steps by the crane. Finally, the completed reinforcing cage, in this case an outer reinforcing cage 3, is transported away by the crane.

What is claimed is:

1. An apparatus for producing reinforcing cages for rectangular concrete pipes, the reinforcing cages having a plurality of longitudinal steel wires and a plurality of transverse steel wires, the longitudinal wires crossing the transverse wires at a crossing points to form a lattice, and the longitudinal wires being welded to the transverse wires at the crossing points, the apparatus comprising:

a framework that guides that longitudinal wires and displaces the longitudinal wires in the longitudinal direction so that the longitudinal wires are displaced together with each other; and a stationary fitting apparatus that cuts a wire with a predetermined thickness into the transverse wires, and positions the transverse wires onto the longitudinal wires so that the transverse wires are spaced from each other by a predetermined spacing, the stationery fitting apparatus comprising a welding device that automatically welds the transverse wires to the longitudinal wires.

2. Apparatus according to claim 1, wherein the framework is mounted so that it can be rotated about an axis of rotation which is parallel to the longitudinal wires.

3. Apparatus according to claim 1, wherein the framework is aligned vertically, and the longitudinal wires are raised during the production sequence and fitted from top to bottom with the transverse wires.

4. Apparatus according to claim 1, wherein the framework comprises a top, perforated frame, which is arranged at a constant height, and a bottom, receiving frame, which can be raised.

5. Apparatus according to claim 4, wherein the receiving frame can be raised in steps, in the horizontal position, in a program-controlled manner by means of a lifting apparatus arranged in the interior of the receiving frame.

6. Apparatus according to claim 1, further comprising a crane system for gripping a not-yet completed reinforcing cage and raising the cage in steps, in a program-controlled manner, in a last phase of the production sequence.

7. Apparatus according to claim 6, wherein the crane system removes a completed reinforcing cage from the framework and joins it together with a previously produced reinforcing cage having a different width.

8. Apparatus according to claim 1, wherein the framework comprises a top, perforated frame, and the fitting apparatus is arranged on a plane of the perforated frame and draws off wire from at least one wire roll, via an aligning means and cuts said wire to length as required and forms a resulting rectilinear transverse—wire section and pushes the transverse-wire section transversely up to one side of the longitudinal-wire configuration.

9. Apparatus according to claim 8, wherein the fitting apparatus contains two bending apparatuses, so that before the transverse-wire section is pushed up to the longitudinal wires the bending apparatus deforms the transverse-wire section at one end thereof to form a transverse-wire angle.

10. Apparatus according to claim 9, wherein the bending apparatuses each have a radius template and a bending arm fitted with a bending roller, for moving downward, following the bending operation, to the extent where they do not obstruct the action of the transverse-wire section being pushed up to the longitudinal wires.

11. Apparatus according to claim 9, wherein the bending apparatuses deform both ends of the transverse wires to form a U-shaped transverse-wire bracket.

12. Apparatus according to claim 8, wherein the fitting apparatus is assigned two wire rolls with wire of different thickness.

13. Apparatus according to claim 8, comprising two fitting apparatuses fed by two wire rolls provided on two opposite sides of the framework.

14. Apparatus according to claim 1, comprising a welding apparatus which can be moved rectilinearly in two mutually perpendicular directions in a movement region for welding transverse wires on a first side surface of the longitudinal wires, the welding apparatus moving back from the framework to provide the framework and the longitudinal wires space for a 90° rotation, and then moving forward to perform a welding operation on a second side surface adjoining the first side surface.

15. Apparatus according to claim 1, comprising a radially displaceable welding apparatus having a welding wheel that is advanced on the transverse wires by movement of the welding apparatus relative to the rotating framework.

16. Apparatus according to claim 1, comprising two welding apparatuses provided on sides of the framework situated opposite one another and located on sides of the framework not occupied by a fitting apparatus.

* * * * *